US011859605B2

(12) United States Patent
Matsuzaka et al.

(10) Patent No.: US 11,859,605 B2
(45) Date of Patent: Jan. 2, 2024

(54) COMPRESSOR SYSTEM, AND CONTROL METHOD FOR SAME

(71) Applicant: Hitachi Industrial Equipment Systems Co., Ltd., Tokyo (JP)

(72) Inventors: Takehiro Matsuzaka, Tokyo (JP); Masakatsu Okaya, Tokyo (JP)

(73) Assignee: HITACHI INDUSTRIAL EQUIPMENT SYSTEMS CO., LTD., Tokyo (JP)

( * ) Notice: Subject to any disclaimer, the term of this patent is extended or adjusted under 35 U.S.C. 154(b) by 268 days.

(21) Appl. No.: 17/437,455

(22) PCT Filed: Feb. 28, 2020

(86) PCT No.: PCT/JP2020/008208
§ 371 (c)(1),
(2) Date: Sep. 9, 2021

(87) PCT Pub. No.: WO2020/195528
PCT Pub. Date: Oct. 1, 2020

(65) Prior Publication Data

US 2022/0163027 A1 May 26, 2022

(30) Foreign Application Priority Data

Mar. 27, 2019 (JP) ..... 2019-060766

(51) Int. Cl.
*F04B 39/06* (2006.01)
*F04C 29/04* (2006.01)
(Continued)

(52) U.S. Cl.
CPC ..... *F04B 39/06* (2013.01); *F04C 28/06* (2013.01); *F04C 28/26* (2013.01); *F04C 29/04* (2013.01)

(58) Field of Classification Search
CPC ..... F04B 39/06; F04B 39/062; F04C 29/04; F15B 21/0423; F15B 21/0427; F15B 21/048
See application file for complete search history.

(56) References Cited

U.S. PATENT DOCUMENTS 10,578,339 B2 * 3/2020 Yamamoto ..... F04B 39/06
10,704,567 B2 * 7/2020 Meeusen ..... F04C 29/04
(Continued)

FOREIGN PATENT DOCUMENTS

JP 11-022688 A 1/1999
JP 2002-285971 A 10/2002
(Continued)

OTHER PUBLICATIONS

International Search Report of PCT/JP2020/008208 dated May 19, 2020.

*Primary Examiner* — Michael Leslie
(74) *Attorney, Agent, or Firm* — MATTINGLY & MALUR, PC

(57) ABSTRACT

A system has a compressor for discharging compressed gas, an aftercooler for cooling the compressed gas, a first cooling liquid pathway for supplying a cooling liquid to the compressor and for cooling the cooling liquid by means of a cooling heat exchanger, and a second cooling liquid pathway for passing the cooling liquid through the aftercooler and for recovering waste heat from the cooling liquid by means of a heat recovery heat exchanger, in which the compressor system includes a first valve and a second valve disposed in a plurality of bypass pathways connecting the first cooling liquid pathway and the second cooling liquid pathway, a third valve and a fourth valve disposed in the first cooling liquid pathway, and a control unit, and in which the control
(Continued)

unit performs first control to close the first valve and the second valve and open the third valve and the fourth valve.

9 Claims, 8 Drawing Sheets

(51) Int. Cl.
*F04C 28/06* (2006.01)
*F04C 28/26* (2006.01)

(56) References Cited

U.S. PATENT DOCUMENTS

| | | | | |
|---|---|---|---|---|
| 2018/0258952 | A1 | 9/2018 | Meeusen et al. | |
| 2022/0106954 | A1* | 4/2022 | Klaus | F04C 29/04 |
| 2022/0341426 | A1* | 10/2022 | Matsuzaka | F04C 29/04 |

FOREIGN PATENT DOCUMENTS

| | | | | |
|---|---|---|---|---|
| JP | 2016-79894 | A | 5/2016 | |
| JP | 2018-145965 | A | 9/2018 | |
| WO | WO-2017111120 | A1 * | 6/2017 | F04B 39/06 |

* cited by examiner

COMPRESSOR SYSTEM, AND CONTROL METHOD FOR SAME

TECHNICAL FIELD

The present invention relates to a compressor system that recovers waste heat from a gas compressor.

BACKGROUND ART

In the related art, a compressor system is known in which in a compressor that compresses gas such as air, heat is exchanged between a fluid of a high temperature after compression and a cooling liquid of a temperature lower than the high temperature, so that heat is recovered from the fluid of a high temperature and the heated cooling liquid is effectively used.

JP 2016-79894 A (Patent Document 1) discloses the background art related to the technical field. Patent Document 1 discloses a heat recovery system including an air cooler that cools compressed air from an oil-free compressor with circulating water between a cooling tower and the air cooler or cools the compressed air with air blown by a fan; a heat recovery heat exchanger that is provided in an air path from the compressor to the air cooler, and allows heat exchange between the compressed air and the water to produce hot water; and a bypass path that connects an air path from the compressor to the heat recovery heat exchanger and an air path from the heat recovery heat exchanger to the air cooler. The heat recovery system can switch between a heat recoverable state in which the compressed air from the compressor is fed to the air cooler via the heat recovery heat exchanger without flowing through the bypass path and a heat recovery stop state in which the compressed air from the compressor is fed to the air cooler via the bypass path without flowing through the heat recovery heat exchanger. The compressor is a machine that is to be loaded or unloaded, and while the compressor is unloaded, the compressed air does not flow to the heat recovery heat exchanger, but the water can flow through the heat recovery heat exchanger.

CITATION LIST

Patent Document

Patent Document 1: JP 2016-79894 A

SUMMARY OF THE INVENTION

Problems to be Solved by the Invention

In Patent Document 1, the usual air path and the bypass path to the heat recovery heat exchanger are provided, and depending on whether the compressor performs a load operation or an unload operation, an operation is performed in which the opening and closing of a valve is controlled to allow the water to flow to the heat recovery heat exchanger or stop the flow of the water, and excessive start and stop of a water supply pump that causes the water to flow to the heat recovery heat exchanger is suppressed, which is an object.

However, in Patent Document 1, a method for cooling the compressor itself has not been mentioned. Generally, low-pressure stage and high-pressure stage compressors themselves are required to be cooled by a certain method such as air cooling or liquid cooling. However, in Patent Document 1, when due to an increase in ambient temperature of the installation location of a compressor unit including the compressor, the temperature of compressed gas discharged by the compressor becomes higher than usual, and approaches the alarm temperature of the compressed gas, an operating method has not been mentioned such as how to continue or stop the cooling of the compressor and the compressed gas and heat recovery.

In addition, when the water cannot be supplied to the heat recovery heat exchanger due to a failure of the water supply pump that causes the water to flow to the heat recovery heat exchanger, a method on how to continue the cooling of the compressed gas and how to operate the compressor has not been described and taken into consideration.

Solutions to Problems

As one example of the present invention, there is provided a compressor system including: a compressor that compresses suctioned gas to discharge compressed gas; an aftercooler that cools the compressed gas; a first cooling liquid pathway through which a cooling liquid is supplied to the compressor by a first pump, the cooling liquid being cooled by a cooling heat exchanger; a second cooling liquid pathway through which the cooling liquid is caused to flow through the aftercooler by a second pump, waste heat from the cooling liquid being recovered by a heat recovery heat exchanger; a first valve disposed in a bypass pathway on a suction side of the first pump among a plurality of bypass pathways that connect the first cooling liquid pathway and the second cooling liquid pathway; a second valve disposed in a bypass pathway on a discharge side of the first pump; a third valve on the discharge side of the first pump and a fourth valve on the suction side of the first pump, the third valve and the fourth valve controlling circulation of the cooling liquid from the first pump in the first cooling liquid pathway; and a control unit that controls the first valve, the second valve, the third valve, and the fourth valve. The control unit performs first control to close the first valve and the second valve and open the third valve and the fourth valve, and performs second control to open the first valve and the second valve and close the third valve and the fourth valve.

Effects of the Invention

According to the present embodiment, it is possible to provide the compressor system and a control method for the same which, while cooling the compressor, the compressed gas, and a lubricant such that the temperature of the compressed gas can be maintained less than an alarm temperature as far as possible at which the compressed gas becomes hotter than usual, can continue heat recovery from these high-temperature heat sources.

MODE FOR CARRYING OUT THE INVENTION

Hereinafter, specific embodiments of a compressor system of the present invention will be described based on the drawings.

First Embodiment

Figure 1:
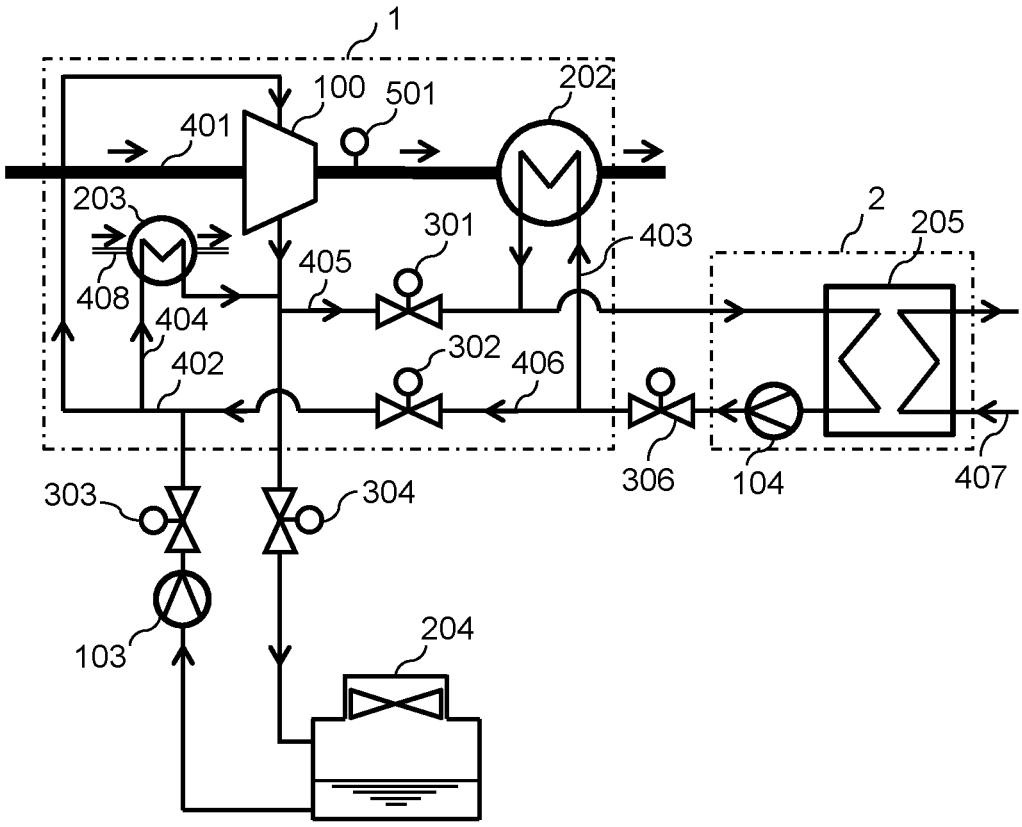
FIG. 1 is a system diagram of a compressor system in a first embodiment.

FIG. 1 is a system diagram of a compressor system in the present embodiment. In the present embodiment, an example will be described in which the present invention is applied to a water-cooled oil-free screw compressor as a compressor unit. In addition, an oil-free screw compressor illustrated in FIG. 1 is configured as a water-cooled gas compressor that suctions, compresses, and discharges gas (air in the present embodiment).

In FIG. 1, a compressor unit 1 includes a single-stage compressor 100 that suctions air through an air pathway 401, compresses the air to a predetermined pressure, and discharges the compressed air, and a water-cooled aftercooler 202 that cools discharged high-temperature compressed air. A discharge air temperature sensor 501 that measures the temperature of the discharged high-temperature compressed air is installed on the air pathway 401 downstream of the compressor 100.

In addition, a water-cooled oil cooler 203 is provided that cools a lubricant which lubricates the compressor 100 and a drive mechanism not illustrated, and the lubricant is supplied to each part, namely, a necessary place inside the compressor unit 1 through a lubricant pathway 408 and is circulated. The compressor 100 and the oil cooler 203 are usually cooled by cooling water flowing through a first cooling liquid pathway 402 and an oil cooler cooling pathway branching from the first cooling liquid pathway 402. The cooling water in the first cooling liquid pathway 402 is circulated by a cooling pump 103, and releases heat in a cooling heat exchanger 204 represented by a cooling tower or the like. In the first cooling liquid pathway 402, a supply water valve 303 is disposed on a discharge side of the cooling pump 103, and a supply water valve 304 is disposed on a pathway on a suction side of the cooling pump 103, the pathway allowing the cooling water to return to the cooling heat exchanger 204.

Generally, the cooling pump 103 and the cooling heat exchanger 204 are shared with existing equipment separate from the compressor unit 1 in the present embodiment and a heat recovery unit 2 to be described later. For this reason, unless requested as requirement specifications by a user, the compressor unit 1 or the heat recovery unit 2 does not directly control the operation of a circulation pump 104 or the cooling heat exchanger 204.

In the compressor system of the present embodiment, the heat recovery unit 2 is installed side by side with the compressor unit 1. The heat recovery unit 2 includes a heat recovery heat exchanger 205 and the circulation pump 104, and a suction side of the circulation pump 104 is connected to a high-temperature fluid side outlet side of the heat recovery heat exchanger 205. In addition, a discharge side of the circulation pump 104 is connected to a cooling water inlet side of the aftercooler 202 in the compressor unit 1, and a cooling water outlet side of the aftercooler 202 is connected to a high-temperature fluid side inlet side of the heat recovery heat exchanger 205, so that a second cooling liquid pathway 403 is formed. A supply water valve 306 is disposed on the discharge side of the circulation pump 104 in the second cooling liquid pathway 403. The supply water valve 306 operates in connection with the circulation pump 104, and is opened during operation of the circulation pump 104.

A low-temperature side fluid pathway 407 of the heat recovery heat exchanger 205 is a pathway through which a liquid such as relatively low-temperature water is supplied from the outside, and is a pathway through which the liquid exchanges heat with high-temperature circulating water, which has increased in temperature after having cooled high-temperature compressed air in the aftercooler 202, in the second cooling liquid pathway 403 to be heated and returns to the outside again. The water circulating in the low-temperature side fluid pathway 407 is not particularly limited in use, and can be widely used for, for example, the preheating of boiler supply water, hot water heating, showering, and the like.

In addition, a first bypass pathway 405 is formed that branches from a downstream side of a cooling water outlet of the compressor 100 on the first cooling liquid pathway 402, and that is connected to a portion downstream of a cooling water outlet of the aftercooler 202 on the second cooling liquid pathway 403. In addition, a second bypass pathway 406 is formed that branches from an upstream side of a cooling water inlet of the aftercooler 202 on the second cooling liquid pathway 403, and that is connected to a portion downstream of and close to the supply water valve 303 on the first cooling liquid pathway 402. In addition, the first cooling liquid pathway 402 and the second cooling liquid pathway 403 communicate with the first bypass pathway 405 and the second bypass pathway 406, respectively. An electromagnetic valve 301 is provided on the first bypass pathway 405, and an electromagnetic valve 302 is provided on the second bypass pathway 406.

Figure 2:
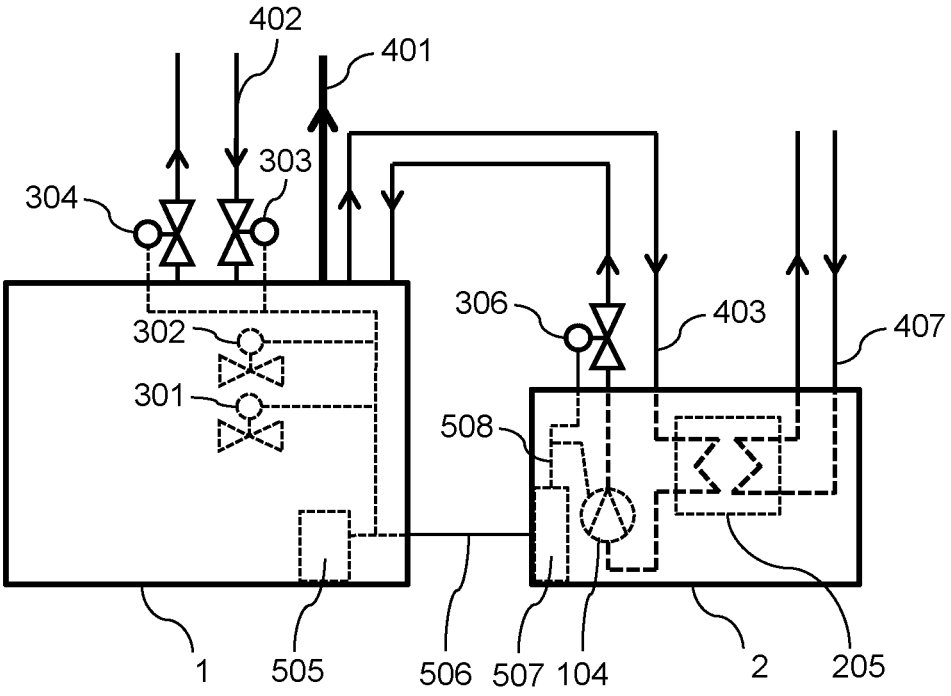
FIG. 2 is a wiring and pipe connection diagram of the compressor system in the first embodiment.

FIG. 2 is a simple wiring and pipe connection diagram of the compressor system in the present embodiment. In FIG. 2, a control device 505 is provided in the compressor unit 1. The control device 505 performs the operation and stop of an electric motor not illustrated that drives mainly the compressor 100, discharge air pressure control by rotation speed control or switching between a load operation and an unload operation, and the like. A control device 507 is provided in the heat recovery unit 2. The control device 507 is mainly responsible for the operation, stop, rotation speed control, and the like of the circulation pump 104, and controls the opening and closing of the electromagnetic valves 301 and 302 and the supply water valves 303, 304, and 306 on the respective water pathways of the parts via control wirings 506 and 508.

Figure 3:
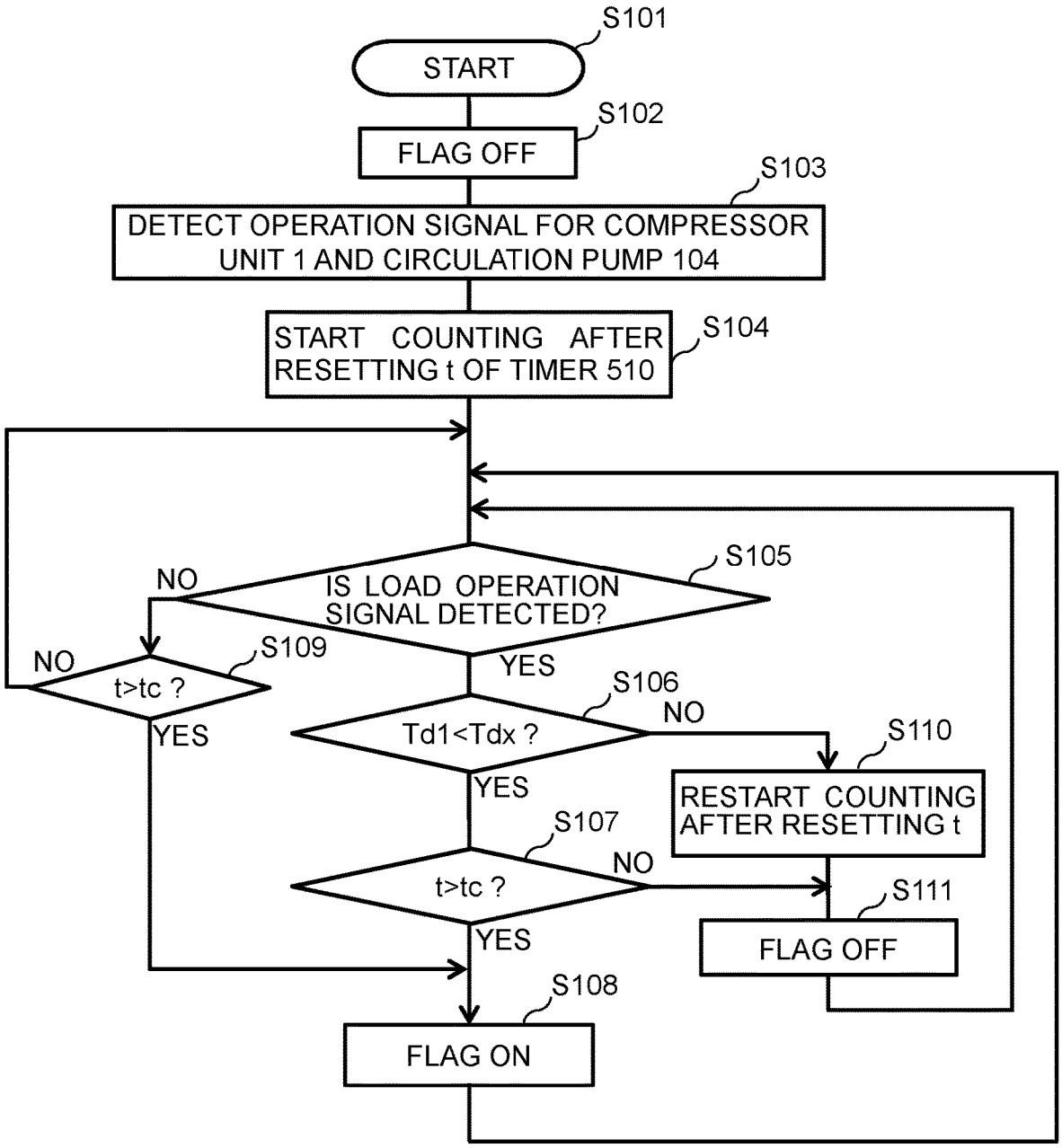
FIG. 3 is a flowchart of control performed by a control device of a heat recovery unit in the first embodiment.

FIG. 3 is a flowchart of control performed by the control device 507 of the heat recovery unit 2 in the present embodiment. In FIG. 3, when a power supply is turned on, control is started in step S101. In step S102, a heat recovery mode A is defined in which the electromagnetic valve 301 and the electromagnetic valve 302 are closed and the supply water valves 303 and 304 are opened, and at this time, a flag inside the control device 507 is initialized to OFF. Next, in step S103, a signal, which indicates that the compressor unit 1 has started operation, from the control device 505 in the compressor unit 1 is detected, and a signal indicating that the circulation pump 104 in the heat recovery unit 2 is detected.

Then, in step S104, after a time variable t counted by a timer 510 inside the control device 507 is reset, the counting is started again.

Next, in step S105, it is determined whether or not a load operation signal from the compressor unit 1 is detected. If detected, the process proceeds to step S106, and if not detected, the process branches to step S109.

In a case where the load operation signal is detected, in step S106, when a discharge air temperature Td1 detected by the discharge air temperature sensor 501 is smaller than a predetermined temperature threshold value Tdx, the process proceeds to step S107, and when the discharge air temperature Td1 is the predetermined temperature threshold value Tdx or more, the process branches to step S110. Here, it is desirable that the temperature threshold value Tdx is set to a temperature slightly lower than Tda representing a discharge air alarm temperature (for example, 395° C. or the like with respect to Tda=400° C.)

In step S107, it is determined whether or not the time variable t counted by the timer 510 is larger than a predetermined set time tc, and if larger, the process proceeds to step S108, and if smaller, the process branches to step S111. Here, the set time tc is the time set to limit the frequency of switching between the heat recovery modes A and B, and is set to, for example, three minutes or the like. Since the set time tc is set, the frequency of opening and closing of the electromagnetic valves or the supply water valves can be suppressed, and the component life can be suppressed from becoming extremely short.

In step S108, the heat recovery mode B is started which defines a state where the electromagnetic valve 301 and the electromagnetic valve 302 are opened and the supply water valves 303 and 304 are closed, and the flag at this time is set to ON. After the execution of step S108, the process returns to step S105.

In step S109, if the time variable t is larger than the predetermined set time tc, the process proceeds to step S108, and if smaller, the process returns to step S105. In step S110, the time variable t is reset once, and the counting is restarted from 0 again.

In step S111, the flag is set to OFF, namely, the heat recovery mode A is executed. When the heat recovery mode A is executed, as for the flow of the cooling water, the first cooling liquid pathway 402 and the second cooling liquid pathway 403 are independent of each other. The cooling of the compressor 100 and the oil cooler 203 are performed in the cooling heat exchanger 204, which is disposed outside, via the first cooling liquid pathway 402. The cooling of the aftercooler 202 can be performed in the second cooling liquid pathway only by the water circulated by the circulation pump 104, heat exchange between the water of the second cooling liquid pathway which is a high-temperature side fluid and the water of the low-temperature side fluid pathway 407 can be performed in the heat recovery heat exchanger 205, and the heat extracted from the high-temperature compressed air can be supplied to the outside as hot water.

Next, an effect of executing the heat recovery mode A will be described below. For example, ambient temperature increases due to the influence of the installation environment of the compressor unit 1, and accordingly, the temperature of the compressed air to be discharged increases, and reaches the discharge air alarm temperature Tda in some cases, which is a problem. In that case, in order to prevent a failure caused by the overheating of the compressor 100, generally, while safely cooling the compressor 100 and the oil cooler 203 with the cooling heat exchanger 204 having a cooling capacity sufficiently larger than the heat quantity released by the compressor unit 1, heat can be recovered from the cooling water in the second cooling liquid pathway, which has flowed through the aftercooler 202 and increased in temperature, to a low-temperature side fluid in the low-temperature side fluid pathway 407 via the heat recovery heat exchanger 205.

Next, an effect of executing the heat recovery mode B will be described below. For example, in an operation state where the amount of air to be used at a demand destination is small and the load factor of the compressor 100 is low, and accordingly, the rotation speed of the compressor 100 is lowered to reduce the amount of discharged air or the operation mode is switched to the unload operation to generate almost no amount of discharged air, the heat quantity that can be recovered from the compressed air is greatly reduced. In that case, since the compressor 100 requires cooling regardless of the load operation or the unload operation, the heat recovery mode B is executed, so that a first cooling liquid circuit and a second cooling liquid circuit communicate with the first bypass pathway 405 and the second bypass pathway 406, respectively. In addition, meanwhile, the cooling heat exchanger 204 is functionally disconnected to close the supply water valves 303 and 304, so that the cooling water can be circulated inside the compressor unit 1 and the heat recovery unit 2 only by the circulation pump 104, and the compressor 100, the aftercooler 202, and the oil cooler 203 each are cooled, and heat can be recovered from all the cooling water, which has increased in temperature, to the low-temperature side fluid pathway 407 via the heat recovery heat exchanger 205. Therefore, even in a state where the load factor of the compressor 100 is low, a reduction in recovered heat quantity is suppressed, and energy is saved. In addition, even in an operation state where the load factor during load operation is close to 100%, when a condition is satisfied in which the discharge air temperature Td1 is less than the temperature threshold value Tdx, and a condition is satisfied in which the time variable t is larger than the set time tc, the heat recovery mode B is executed. Therefore, there is no influence such as the overheating of the compressor 100 on reliability, a large heat quantity can be recovered, and the effect of large energy saving can be obtained.

As described above, according to the present embodiment, it is possible to provide the compressor system and a control method for the same which, in the water-cooled gas compressor in which the compressor, compressed gas, or the lubricant is cooled by water, while effectively cooling the compressor, the compressed gas, and the lubricant such that the temperature of the compressed gas can be maintained less than the alarm temperature as far as possible at which the compressed gas becomes hotter than usual, can continue heat recovery from these high-temperature heat sources.

Second Embodiment

Figure 4:
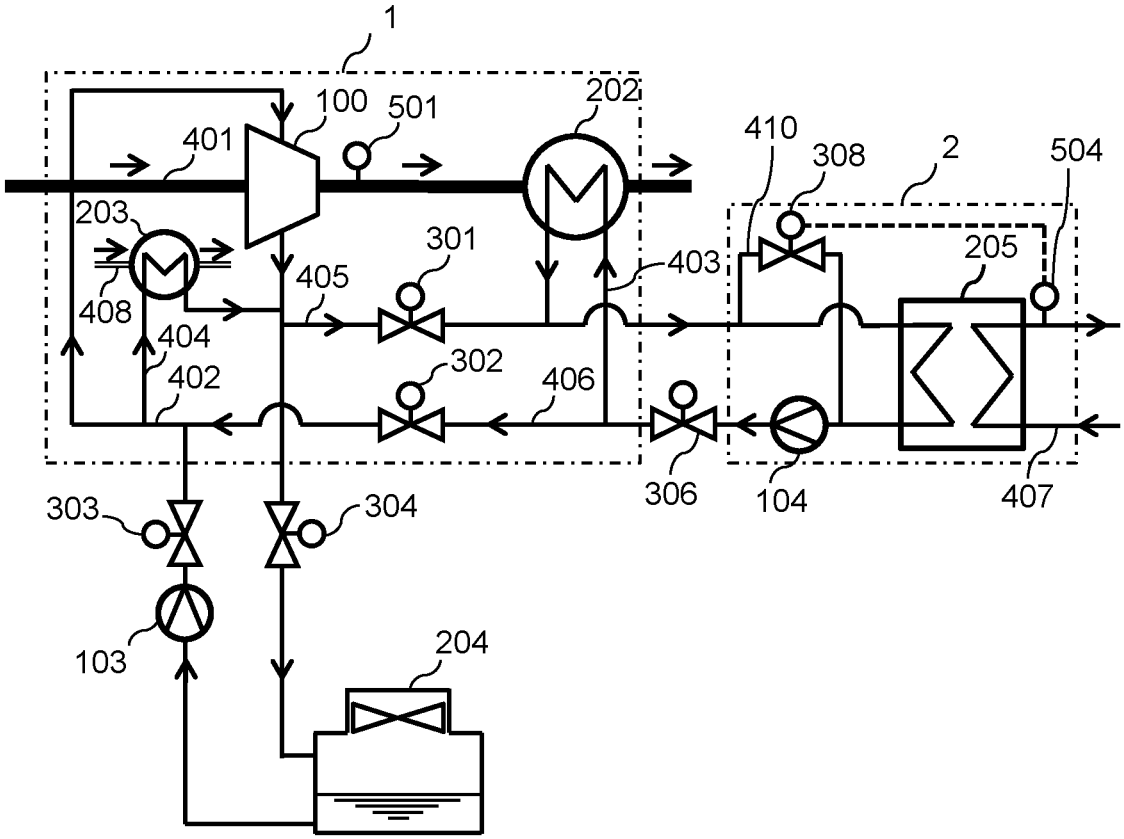
FIG. 4 is a system diagram of a compressor system in a second embodiment.

FIG. 4 is a system diagram of a compressor system in the present embodiment. In FIG. 4, parts denoted by the same reference signs as those in FIGS. 1 to 3 of the first embodiment indicate the same or corresponding parts, and a description of the parts will be omitted.

In the present embodiment, a bypass pathway 410 communicating with an inlet and an outlet of the heat recovery heat exchanger 205 is provided on the second cooling liquid pathway 403, and a temperature regulation valve 308 is provided on the bypass pathway 410. The temperature regulation valve 308 has a function of automatically regulating the valve opening degree such that a low-temperature side fluid outlet temperature Tu of a temperature sensor 504 which measures the temperature of an outlet side of the heat recovery heat exchanger 205 on the low-temperature side fluid pathway 407 is a predetermined target temperature Tux. The purpose of providing the temperature regulation valve 308 is to obtain an effect of enabling the low-temperature side fluid outlet temperature Tu to reach the target temperature Tux more quickly.

In the present embodiment, it is assumed that the temperature regulation valve 308 is a two-way automatic valve which is completely closed when as the low-temperature side fluid outlet temperature Tu measured by the temperature sensor 504 approaches the target temperature Tux, the volume of a liquid with which the inside of the temperature regulation valve 308 is filled expands to apply force to an opening and closing mechanism inside a valve body, the valve opening degree is gradually reduced, and the target temperature Tux is reached.

When the low-temperature side fluid outlet temperature Tu is still sufficiently lower than the target temperature Tux, the temperature regulation valve 308 is at the maximum opening degree. In this case, the cooling water of a corresponding flow rate according to a ratio between the diameter of a pipe forming the bypass pathway 410 and the diameter of a pipe forming the second cooling liquid pathway 403 returns to the suction side of the circulation pump 104 without flowing through the heat recovery heat exchanger 205, and is discharged again. Then, since a part of the cooling water does not flow through the heat recovery heat exchanger 205, the hot water that has not been subjected to heat exchange receives heat from the high-temperature compressed air in the aftercooler 202 again. Since this circulation is continued, the temperature in the second cooling liquid circuit increases more quickly, and accordingly, the low-temperature side fluid outlet temperature Tu also increases more quickly. Since the opening degree of the temperature regulation valve 308 is reduced as the low-temperature side fluid outlet temperature Tu approaches the target temperature Tux, the amount of the cooling water flowing through the heat recovery heat exchanger 205 increases. Therefore, the temperature of the cooling water in the second cooling liquid circuit increases gently, and accordingly, the low-temperature side fluid outlet temperature Tu also increases gently. Therefore, an effect of enabling the low-temperature side fluid outlet temperature Tu to reach the target temperature Tux more quickly is obtained by providing the temperature regulation valve 308.

Third Embodiment

Figure 5:
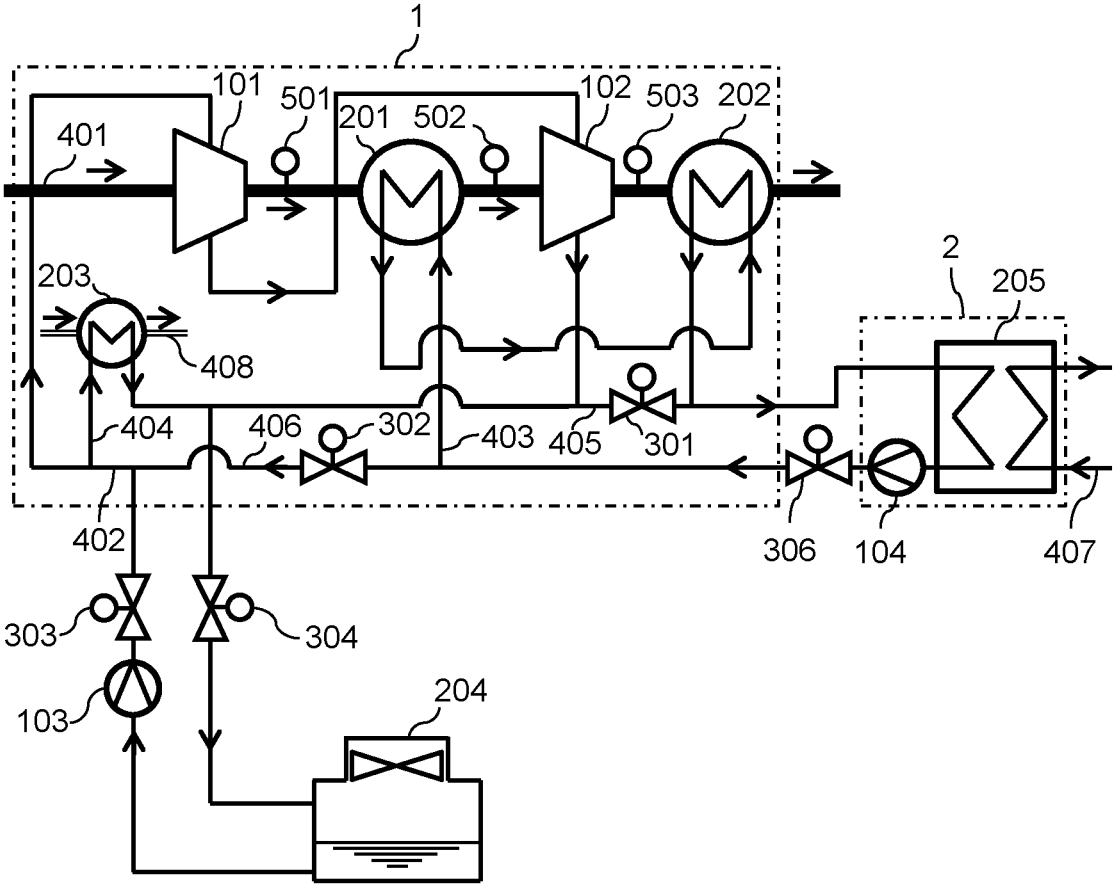
FIG. 5 is a system diagram of a compressor system in a third embodiment.

FIG. 5 is a system diagram of a compressor system in the present embodiment. In FIG. 5, parts denoted by the same reference signs as those in FIGS. 1 to 4 indicate the same or corresponding parts, and a description of the parts will be omitted.

In the present embodiment, the compressor unit 1 includes a multi-stage oil-free screw compressor in which air is compressed to a predetermined pressure by a plurality of stages of compressors. As illustrated in FIG. 5, the compressor system includes a low-pressure stage compressor 101; a high-pressure stage compressor 102; an intercooler 201 that cools compressed air discharged from the low-pressure stage compressor 101; and the aftercooler 202 that cools compressed air discharged from the high-pressure stage compressor 102. In addition, on the air pathway 401, the low-pressure stage discharge air temperature sensor 501 is provided that measures the temperature of the discharged air from the low-pressure stage compressor 101, a high-pressure stage suction air temperature sensor 502 is provided that measures the temperature of the air which has been cooled in the intercooler 201 but has not yet been suctioned into the high-pressure stage compressor 102, and a high-pressure stage discharge air temperature sensor 503 is provided that measures the temperature of the discharged air from the high-pressure stage compressor 102.

Similar to the first embodiment or the second embodiment, also in the present embodiment, the first cooling liquid pathway 402 and the second cooling liquid pathway 403 are provided. In addition, the first bypass pathway 405 is formed that branches from a downstream side of a cooling water outlet of the high-pressure stage compressor 102 on the first cooling liquid pathway 402, and that is connected to a place downstream of the cooling water outlet of the aftercooler 202 on the second cooling liquid pathway 403. In addition, the second bypass pathway 406 is formed that branches from an upstream side of a cooling water inlet of the intercooler 201 on the second cooling liquid pathway 403, and that is connected to a portion downstream of and close to the supply water valve 303 on the first cooling liquid pathway 402. Then, the first cooling liquid pathway 402 and the second cooling liquid pathway 403 communicate with the first bypass pathway 405 and the second bypass pathway 406, respectively. The electromagnetic valve 301 is provided on the first bypass pathway 405, and the electromagnetic valve 302 is provided on the second bypass pathway 406.

In the case of the heat recovery mode A, namely, in a case where the electromagnetic valve 301 and the electromagnetic valve 302 are closed and the supply water valve 303 and the supply water valve 304 are opened, the cooling water in the first cooling liquid pathway 402 is fed to the low-pressure stage compressor 101, the high-pressure stage compressor 102, and the oil cooler 203 by the cooling pump 103. Meanwhile, a pathway is established in which the cooling water that has flowed through the low-pressure stage compressor 101 flows through the high-pressure stage compressor 102, and then merges with the cooling water that has flowed through the oil cooler 203, and is fed to the cooling heat exchanger 204. In this case, a pathway is established in which the cooling water in the second cooling liquid pathway 403 is fed to the intercooler 201 by the circulation pump 104, and thereafter, flows through the aftercooler 202, flows through the heat recovery heat exchanger 205, exchanges heat with the low-temperature side fluid, and then is discharged again by the circulation pump 104. Namely, a configuration is implemented in which in the first cooling liquid pathway, the low-pressure stage compressor 101 and the high-pressure stage compressor 102 are connected in series to each other and in the second cooling liquid pathway, the intercooler 201 and the aftercooler 202 are connected in series to each other.

In the case of the heat recovery mode B, namely, when the electromagnetic valve 301 and the electromagnetic valve 302 are opened and the supply water valve 303 and the supply water valve 304 are closed, all the cooling water that has been heated in the low-pressure stage compressor 101, the high-pressure stage compressor 102, the intercooler 201, the aftercooler 202, and the oil cooler 203 can exchange heat with the low-temperature side fluid pathway 407 via the heat recovery heat exchanger 205, and the low-temperature side fluid can be heated and supplied.

As described above, in a method in which the plurality of compressors or the coolers are connected in series to each other and the cooling water flows therethrough, a higher cooling water temperature can be obtained than in a method in which these elements are connected in parallel to each other and the cooling water of the same flow rate flows therethrough. Namely, since the low-temperature side fluid temperature after heat exchange in the heat recovery heat exchanger 205 can be a high temperature, the temperature range of the low-temperature side fluid that can be supplied can be widened.

Incidentally, control of each valve in the present embodiment can be performed in the same procedure as the flowchart of FIG. 3. Meanwhile, it is desirable that the predetermined temperature threshold value Tdx of the compressed air is set to a temperature lower than a low-pressure stage discharge air alarm temperature Td1*a* and a high-pressure stage discharge air alarm temperature Td2*a*, for example, with respect to Td1*a*=215° C. and Td2*a*=220° C., Tdx is set to 210° C. which is slightly lower than both the alarm temperatures. In this case, it is desirable that the determination condition in step S106 of FIG. 3 is set to "Td1<Tdx and Td2<Tdx" using the low-pressure stage discharge air temperature Td1 by the low-pressure stage discharge air temperature sensor 501 and the high-pressure stage suction air temperature Td2 by the high-pressure stage suction air temperature sensor 502, and this setting can contribute to protecting both the low-pressure stage compressor 101 and the high-pressure stage compressor 102 from an overheating state.

Fourth Embodiment

Figure 6:
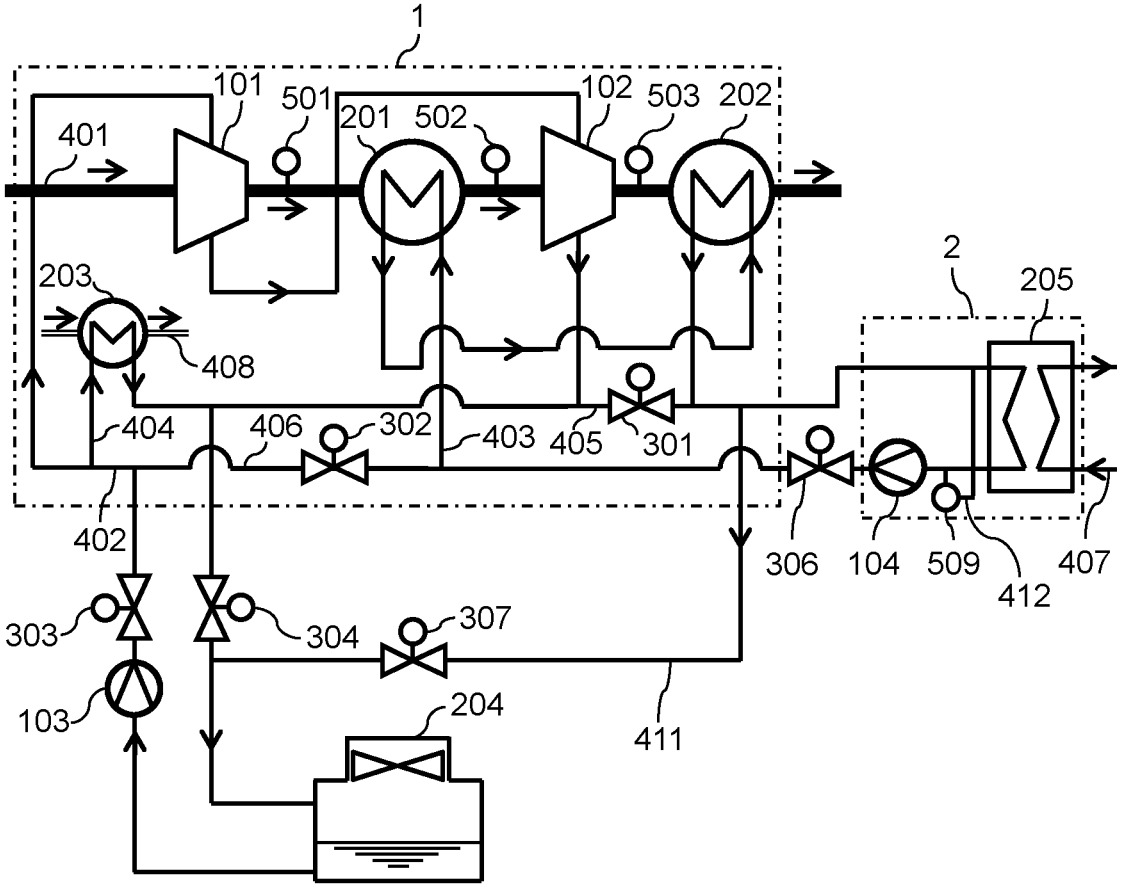
FIG. 6 is a system diagram of a compressor system in a fourth embodiment.

FIG. 6 is a system diagram of a compressor system in the present embodiment. In FIG. 6, parts denoted by the same reference signs as those in FIGS. 1 to 5 indicate the same or corresponding parts, and a description of the parts will be omitted.

In the present embodiment, a bypass pathway 411 is provided that branches from between the cooling water outlet of the aftercooler 202 on the second cooling liquid pathway 403 and the inlet of the heat recovery heat exchanger 205, and that merges with a portion between a downstream side of the supply water valve 304 on the first cooling liquid pathway 402 and the cooling heat exchanger 204. A supply water valve 307 is provided on the bypass pathway 411. In addition, in order to detect a pressure difference between the inlet and the outlet of the heat recovery heat exchanger 205 on the second cooling liquid pathway 403, a differential pressure switch 509 is provided that opens and closes an internal electric circuit according to the pressure difference, and a detection pipe 412 is provided that introduces the pressures of the inlet and the outlet of the heat recovery heat exchanger 205 to the differential pressure switch 509.

By any chance, when the circulation pump 104 fails or clogging occurs inside the heat recovery heat exchanger 205, the intercooler 201 and the aftercooler 202 cannot be cooled during execution of the heat recovery mode A. In addition, during execution of the heat recovery mode B, in addition to the coolers, the low-pressure stage compressor 101, the high-pressure stage compressor 102, and the oil cooler 203 cannot be cooled. For this reason, the compressor unit 1 has to be stopped automatically to prevent a serious failure, so that the supply of the compressed air which is relatively important than the supply of the hot water by heat recovery is stopped.

The present embodiment is configured for the purpose of preventing the above-described event, and securing the cooling of each element inside the compressor unit 1 and continuing to supply the compressed air even when a defect such as a failure of the circulation pump 104 occurs.

In the control performed by the control device 507 of the heat recovery unit in the present embodiment, a case where the circulation pump 104 fails to cause the stop of the operation or clogging occurs inside the heat recovery heat exchanger 205 to cause the water not to flow is determined as a failure. Namely, usually, the differential pressure switch 509 determines a failure in such a manner that when the water flows, a pressure difference is generated and the differential pressure switch 509 does not operate, and when the water does not flow, the pressure difference is 0 and the differential pressure switch 509 operates. In that case, a backup cooling mode is performed to open the electromagnetic valve 301, the electromagnetic valve 302, the supply water valve 303 and the supply water valve 307 and close the supply water valve 304 and the supply water valve 306.

Accordingly, the first cooling liquid pathway 402 and the second cooling liquid pathway 403 communicate with each other, but all the cooling water is cooled in the cooling heat exchanger 204, so that all the elements requiring cooling inside the compressor unit 1 are cooled. Therefore, the stop of the compressor unit 1 caused by a defect on a heat recovery unit 2 side can be prevented.

Incidentally, it is desirable that unless the defect on the heat recovery unit 2 side is resolved and a failure signal or the like is reset, the backup cooling mode is continued. In addition, a failure may be determined by a water cutoff detection device as another configuration instead of the differential pressure switch as long as a case is detected in which the water does not flow.

In addition, in the present embodiment, the configuration has been described that is obtained by adding a configuration to the configuration of FIG. 5 in the third embodiment, but is not limited thereto, and the same configuration may be added to the configuration of the first or second embodiment.

As described above, according to the present embodiment, even when a water supply pump that supplies water to the heat recovery heat exchanger has failed or the like, the cooling of the compressors, compressed gas, and the lubricant can be continued.

Fifth Embodiment

Figure 7:
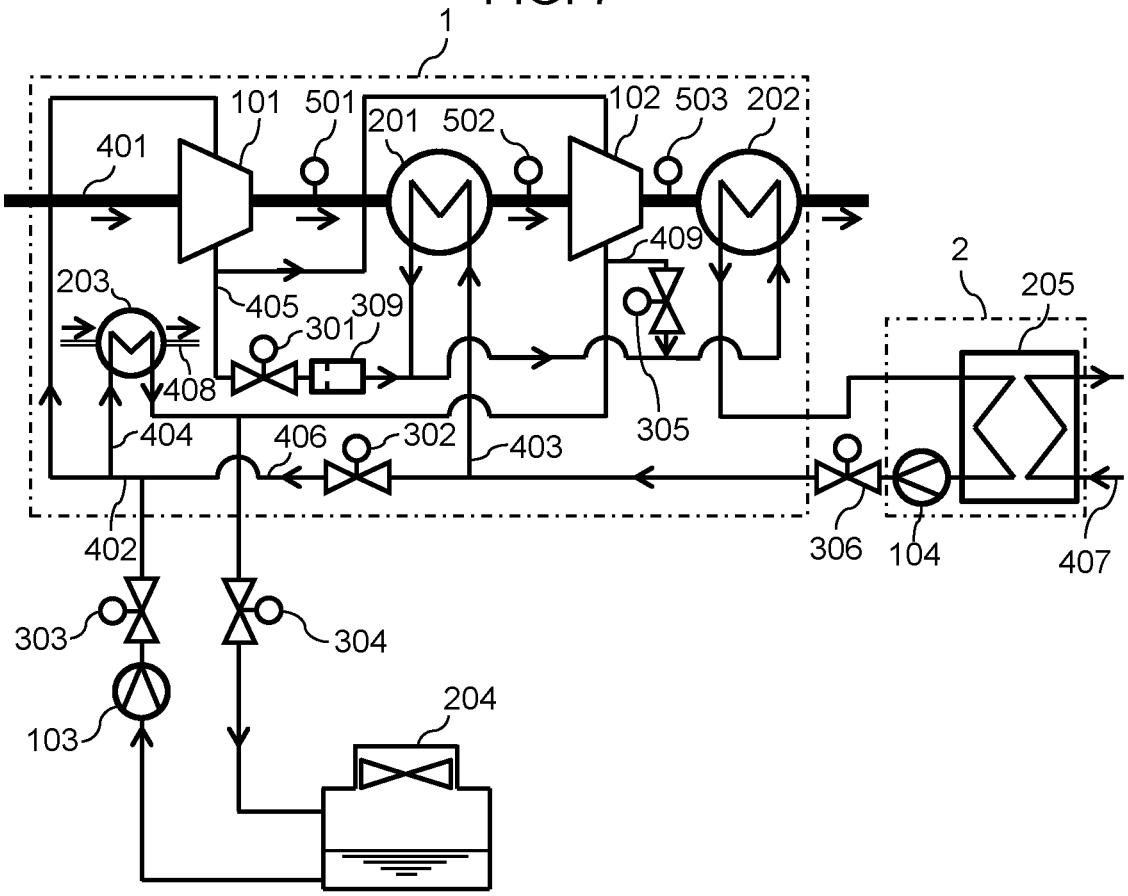
FIG. 7 is a system diagram of a compressor system in a fifth embodiment.

FIG. 7 is a system diagram of a compressor system in the present embodiment. In FIG. 7, parts denoted by the same reference signs as those in FIGS. 1 to 5 indicate the same or corresponding parts, and a description of the parts will be omitted.

In FIG. 7, the first bypass pathway 405 branches from a cooling water outlet of the low-pressure stage compressor 101 on the first cooling liquid pathway 402, and merges with an outlet of the intercooler 201 on the second cooling liquid pathway. The electromagnetic valve 301 and an orifice 309 immediately after the electromagnetic valve 301 are provided on the first bypass pathway 405. In addition, a third bypass pathway 409 branches from a cooling water outlet of the high-pressure stage compressor 102 on the first cooling liquid pathway 402, and merges with a portion upstream of the cooling water inlet of the aftercooler on the second cooling liquid pathway 403. An electromagnetic valve 305 is provided on the third bypass pathway 409.

In the present embodiment, in the heat recovery mode A, control is performed to close the electromagnetic valve 301, the electromagnetic valve 302, and the electromagnetic valve 305 and open the supply water valve 303 and the supply water valve 304. In addition, in the heat recovery mode B, control is performed to open the electromagnetic valve 301, the electromagnetic valve 302, and the electromagnetic valve 305 and close the supply water valve 303 and the supply water valve 304.

According to the present embodiment, an optimum distribution between a cooling water flow rate flowing into the high-pressure stage compressor 102 and a cooling water flow rate flowing into the aftercooler 202 can be obtained by designing and incorporating the inner diameter of the orifice 309 in advance according to specifications such as the heat exchange performance of the compressors or the coolers and the pressure loss of the cooling water pathway which are known in advance.

Incidentally, in the present embodiment, the bypass pathway 411, the supply water valve 307, the detection pipe 412, and the differential pressure switch 509 that are the configurations of the fourth embodiment may be added.

Sixth Embodiment

Figure 8:
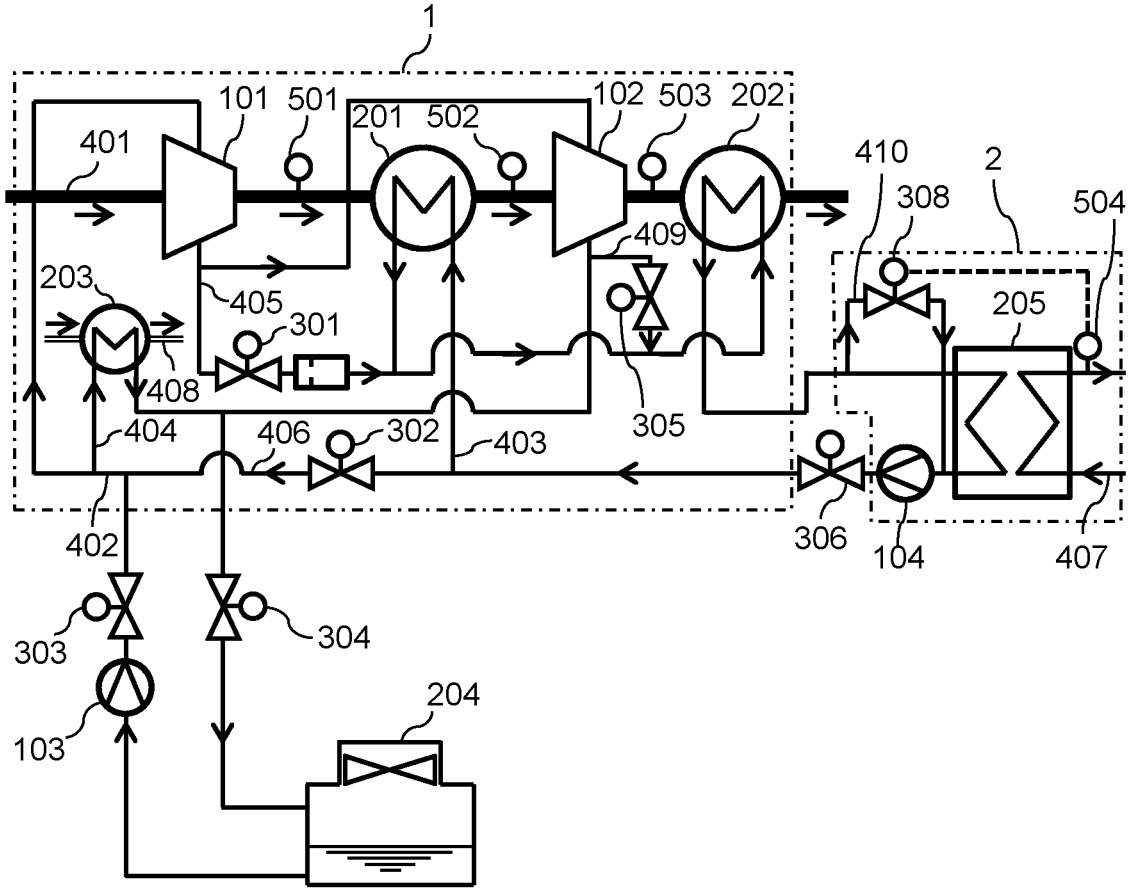
FIG. 8 is a system diagram of a compressor system in a sixth embodiment.

FIG. 8 is a system diagram of a compressor system in the present embodiment. In FIG. 8, parts denoted by the same reference signs as those in FIGS. 1 to 5 and FIG. 7 indicate the same or corresponding parts, and a description of the parts will be omitted.

In the present embodiment, in addition to the configuration of FIG. 7 in the fifth embodiment, the temperature regulation valve 308 and the temperature sensor 504 that is attached to the outlet of the heat recovery heat exchanger 205 on the low-temperature side fluid pathway 407, which are the same as those in the second embodiment, are provided. Therefore, according to the present embodiment, similar to the second embodiment in the fifth embodiment, an effect of enabling the low-temperature side fluid outlet temperature Tu to reach the target temperature Tux more quickly is obtained by providing the temperature regulation valve 308.

Incidentally, in the present embodiment, the bypass pathway 411, the supply water valve 307, the detection pipe 412, and the differential pressure switch 509 that are the configurations of the fourth embodiment may be added.

The embodiments have been described above; however, the present invention is not limited to the above-described embodiments and includes various modification examples. For example, in the embodiments, the example has been described in which the present invention is applied to the oil-free screw compressor; however, the present invention is not limited thereto, and can also be applied to oil-cooled screw compressors or water-injection type screw compressors in the same manner, and can be applied to any fluid machine such as scroll compressors, roots blowers, and turbochargers in the same manner. In addition, in the above-described embodiments, an example of the screw compressor including a pair of male and female screw rotors in a rotor chamber has been described; however, the present invention can also be applied to a single screw compressor including one screw rotor in the same manner. In addition, in the embodiments, the case has been illustrated in which water is used as the cooling liquid circulating through the first cooling liquid pathway and the second cooling liquid pathway; however, it can be assumed that a coolant containing an antifreeze component such as alcohols, or oil is used, and the cooling liquid is not limited to only water. Further, the low-temperature side fluid to be supplied to the outside after heat recovery is also not limited to water, and is assumed to be various fluids.

In addition, the branch positions of the bypass pathways are not limited to only the embodiments, and the bypass pathways may be provided such that the cooling liquid thereinside flows toward the cooling heat exchanger or the heat recovery heat exchanger, and two cooling liquid pathways may be communicatable with each other.

In addition, the above-described embodiments have been described in detail to facilitate the understanding of the present invention, and the present invention is not necessarily limited to including all the configurations that have been described. In addition, a part of a configuration of an embodiment can be replaced with a configuration of another embodiment, and a configuration of another embodiment can be added to a configuration of an embodiment. In addition, other configurations can be added to, removed from, or replaced with a part of the configuration of each of the embodiments. In addition, the control device may be realized by software by causing a processor to interpret and execute a program for realizing each function, or may be realized by hardware by being designed with, for example, an integrated circuit.

REFERENCE SIGNS LIST

1 Compressor unit
2 Heat recovery unit
100 Compressor (single-stage type)
101 Low-pressure stage compressor
102 High-pressure stage compressor
103 Cooling pump
104 Circulation pump
201 Intercooler
202 Aftercooler
203 Oil cooler
204 Cooling heat exchanger
205 Heat recovery heat exchanger
301, 302, 305 Electromagnetic valve
303, 304, 306, 307 Supply water valve
308 Temperature regulation valve
309 Orifice
401 Air pathway
402 First cooling liquid pathway
403 Second cooling liquid pathway
404 Oil cooler cooling pathway
405 First bypass pathway
406 Second bypass pathway
407 Low-temperature side fluid pathway
408 Lubricant pathway
409 Third bypass pathway
410, 411 Bypass pathway
412 Detection pipe
501 Discharge air temperature sensor or Low-pressure stage discharge air temperature sensor
502 High-pressure stage suction air temperature sensor
503 High-pressure stage discharge air temperature sensor
504 Temperature sensor
505, 507 Control device
506, 508 Control wiring
509 Differential pressure switch
510 Timer
Td1 Discharge air temperature or Low-pressure stage discharge air temperature
Td2 High-pressure stage discharge air temperature
Tdx Temperature threshold value
Tda Discharge air alarm temperature
Td1*a* Low-pressure stage discharge air alarm temperature
Td2*a* High-pressure stage discharge air alarm temperature Tu Low-temperature side fluid temperature
Tux Target temperature
tc Set time

The invention claimed is:

1. A compressor system comprising:

a compressor that compresses suctioned gas to discharge compressed gas;

an aftercooler that cools the compressed gas;

a first cooling liquid pathway through which a cooling liquid is supplied to the compressor by a first pump, the cooling liquid being cooled by a cooling heat exchanger;

a second cooling liquid pathway through which the cooling liquid is caused to flow through the aftercooler by a second pump, waste heat from the cooling liquid being recovered by a heat recovery heat exchanger;

a first valve disposed in a bypass pathway on a suction side of the second pump among a plurality of bypass pathways that connect the first cooling liquid pathway and the second cooling liquid pathway;

a second valve disposed in a bypass pathway on a discharge side of the second pump;

a third valve on the discharge side of the first pump and a fourth valve on the suction side of the first pump, the third valve and the fourth valve controlling circulation of the cooling liquid from the first pump in the first cooling liquid pathway; and a control unit that controls the first valve, the second valve, the third valve, and the fourth valve, wherein the control unit performs first control to close the first valve and the second valve and open the third valve and the fourth valve, and performs second control to open the first valve and the second valve and close the third valve and the fourth valve.

2. The compressor system according to claim 1, wherein a second bypass pathway that allows an inlet and an outlet of the heat recovery heat exchanger to communicate with each other is provided in the second cooling liquid pathway, and a temperature regulation valve which regulates an opening degree such that a low-temperature side fluid outlet temperature of the heat recovery heat exchanger is a target temperature is provided on the second bypass pathway.

3. The compressor system according to claim 1, wherein the compressor includes a low-pressure stage compressor and a high-pressure stage compressor that compress the suctioned gas in multiple stages, and an intercooler that cools the compressed gas discharged from the low-pressure stage compressor and the aftercooler that cools the compressed gas discharged from the high-pressure stage compressor are provided.

4. The compressor system according to claim 3, wherein the bypass pathway on a suction side of the second pump branches from a downstream side of the low-pressure stage compressor on the first cooling liquid pathway, the first valve and an orifice downstream of the first valve are provided on the bypass pathway on the suction side of the second pump, the bypass pathway on the suction side of the second pump merges with an outlet side of the intercooler on the second cooling liquid pathway, an additional bypass pathway branches from a downstream side of the high-pressure stage compressor on the first cooling liquid pathway, the additional bypass pathway merges with the bypass pathway on the suction side of the second pump between the intercooler and the aftercooler on the second cooling liquid pathway, and a fifth valve is provided on the additional bypass pathway, and the control unit performs the first control to close the first valve, the second valve, and the fifth valve and open the third valve and the fourth valve, and performs the second control to open the first valve, the second valve, and the fifth valve and close the third valve and the fourth valve.

5. The compressor system according to claim 4, wherein a second bypass pathway that allows an inlet and an outlet of the heat recovery heat exchanger to communicate with each other is provided in the second cooling liquid pathway, and a temperature regulation valve which regulates an opening degree such that a low-temperature side fluid outlet temperature of the heat recovery heat exchanger is a target temperature is provided on the second bypass pathway.

6. The compressor system according to claim 1, wherein a sixth valve is provided to be disposed close to a discharge side of the second pump, a seventh valve is provided on a bypass pathway through which a downstream side of the aftercooler on the second cooling liquid pathway and a downstream side of the fourth valve communicate with each other, and a water cutoff detection device is provided that detects water cutoff of the second cooling liquid pathway, and the control unit performs control to open the first valve, the second valve, the third valve, and the seventh valve and close the fourth valve and the sixth valve when the second pump has failed or the water cutoff detection device has operated.

7. The compressor system according to claim 4, wherein a sixth valve is provided to be disposed close to a discharge side of the second pump, a seventh valve is provided on a bypass pathway through which a downstream side of the aftercooler on the second cooling liquid pathway and a downstream side of the fourth valve communicate with each other, and a water cutoff detection device is provided that detects water cutoff of the second cooling liquid pathway, and the control unit performs control to open the first valve, the second valve, the third valve, the fifth valve, and the seventh valve and close the fourth valve and the sixth valve when the second pump has failed or the water cutoff detection device has operated.

8. A method for controlling a compressor system including a compressor that compresses suctioned gas to discharge the compressed gas, an aftercooler that cools the compressed gas, a first cooling liquid pathway through which a cooling liquid is supplied to the compressor by a first pump, the cooling liquid being cooled by a cooling heat exchanger, and a second cooling liquid pathway through which the cooling liquid is caused to flow through the aftercooler by a second pump, waste heat from the cooling liquid being recovered by a heat recovery heat exchanger, wherein a bypass pathway that connects the first cooling liquid pathway and the second cooling liquid pathway, and a valve disposed in the bypass pathway are provided, and when a discharge gas temperature of the compressed gas that has been discharged is higher than a predetermined temperature, control is performed in a heat recovery mode A in which the valve is closed and the first cooling liquid pathway and the second cooling liquid pathway are independent of each other, and when the discharge gas temperature is lower than the predetermined temperature, control is performed in a heat recovery mode B in which the valve is opened and the first cooling liquid pathway and the second cooling liquid pathway communicate with each other.

9. The method for controlling a compressor system according to claim 8, wherein switching from the heat recovery mode A to the heat recovery mode B is performed after a predetermined time has elapsed.

* * * * *